US006199400B1

(12) United States Patent
Banicevic et al.

(10) Patent No.: US 6,199,400 B1
(45) Date of Patent: Mar. 13, 2001

(54) REFRIGERATOR DAMPER CONTROL AND LIGHTING ASSEMBLY HOUSING

(75) Inventors: Nedo Banicevic, Hamilton; Muc Dang, Burlington, both of (CA)

(73) Assignee: Camco Inc., Mississauga (CA)

( * ) Notice: Subject to any disclaimer, the term of this patent is extended or adjusted under 35 U.S.C. 154(b) by 0 days.

(21) Appl. No.: 09/484,239

(22) Filed: Jan. 18, 2000

(51) Int. Cl.[7] ..... F25D 17/04

(52) U.S. Cl. ..... 62/408; 62/441; 62/298; 62/187; 62/447

(58) Field of Search ..... 62/408, 441, 298, 62/187, 447

(56) References Cited

U.S. PATENT DOCUMENTS

| | | | | |
|---|---|---|---|---|
| 3,115,019 | * | 12/1963 | Rutishauser | 62/408 |
| 3,727,537 | * | 4/1973 | Harty, Jr. | 98/32 |
| 3,733,841 | * | 5/1973 | Gelbard | 62/180 |
| 3,908,392 | | 9/1975 | Schumacher | 62/180 |
| 4,009,591 | | 3/1977 | Hester | 62/180 |
| 4,914,928 | | 4/1990 | Fellwock et al. | 62/408 |
| 4,926,654 | | 5/1990 | Johnson | 62/229 |
| 5,092,137 | | 3/1992 | Elsom | 62/408 |
| 5,097,675 | | 3/1992 | Elsom et al. | 62/408 |
| 5,191,774 | | 3/1993 | Park | 62/408 |
| 5,357,769 | * | 10/1994 | Crabtree et al. | 62/441 |
| 5,385,032 | | 1/1995 | Martin et al. | 62/187 |
| 5,424,210 | * | 6/1995 | Bae et al. | 435/289 |
| 5,701,235 | | 12/1997 | Cook et al. | 362/26 |
| 5,784,895 | * | 7/1998 | Choi | 62/407 |
| 5,870,900 | | 2/1999 | Mohebbi et al. | 62/187 |
| 6,062,037 | * | 5/2000 | Yoon | 62/407 |
| 6,094,932 | * | 8/2000 | Chiappetta | 62/408 |

* cited by examiner

*Primary Examiner*—William Doerrler
*Assistant Examiner*—Mark Shulman

(57) ABSTRACT

A refrigerator damper control and lighting assembly is mounted to a top wall of a fresh food compartment. The housing includes dials which are accessible from the front of the housing to a user to control thermostat and to control a damper located on a rear wall of the refrigerator. The dial controlling the damper has a post onto which a connecting arm to the damper interconnects the damper with the dial so that rotation of the dial effectively operates the control of the damper. The dial has a peripheral flange that extends around only a portion of the circumference of the dial and is adapted to contact opposing sides of the connecting arm to thereby limit rotational movement of the dial and which in-turn limits opening and closing movement of the damper depending on direction of rotational movement of the dial. Further, the housing includes a recessed lamp receiving section which is provided with direct line of sight to the dials so as to allow for light to be directed rearwardly or towards the front of the housing to illuminate the dials while at the same time projecting light into the fresh food compartment.

15 Claims, 3 Drawing Sheets

REFRIGERATOR DAMPER CONTROL AND LIGHTING ASSEMBLY HOUSING

TECHNICAL FIELD OF THE INVENTION

The present invention relates to a refrigerator damper control and lighting housing that provides effective air flow regulation and a single lamp source for illuminating the fresh food compartment and control dials of the housing.

BACKGROUND OF THE INVENTION

Refrigerators have been constructed so that thermostats may be manually adjusted by the user to change the thermostat setting and thus control the temperature inside the refrigerator. In somne refrigerators the control to adjust the thermostat is located at the front of the refrigerator and the thermostat is located adjacent the rear wall of the refrigerator. In most refrigerators an evaporator of the refrigerant system is located adjacent to the fieezer compartment either in the rear wall of the freezer compartment or in the mullion partition separating the freezer compartment from the fresh food compartment. A portion of the cold air resulting from the operation of the evaporator flows into the freezer compartment and a portion is directed to flow into the fresh food compartment. Typically, the thermostat controls the operation of the refrigerant system and is positioned in the fresh food compartment to sense the temperature of the air within the fresh food compartment. The thermostat sensor is located adjacent the cold air entry port into the fresh food compartment which in most cases is at the rear of the compartment.

When the temperature inside the refrigerator reaches a preset upper limit the thermostat turns on the compressor and the refrigerant system is operated in the normal manner to reduce the temperature of the interior compartment of the refrigerator. When the temperature reaches a preset lower limit the thermostat turns the compressor off. It is also known to provide a control adjustment of a damper that controls the amount of air passing through the cold air entry port into the refrigerator compartment. The thermostat control generally maintains the temperature of the refrigerator including the fresh food compartment and the freezer compartment at a set level. The damper control then controls the amount of air entering into the refrigerator compartment so that the relative temperature of the refrigerator relative to the freezer compartment can be adjusted and controlled.

There have been numerous designs for providing housings for permitting manual control of the damper and for providing illumination into the fresh food compartment. However, most damper controls are complicated and require sophisticated mounting and in some instances may not be readily accessible for repair. With respect to the lighting systems, in many refrigerators, the control for the thermostats requires additional light guides in the form of fiber optics or requires the use of an additional lamp source immediately behind the dials used to control either the thermostat and/or the damper. The fiber optics or additional light source are additional costs factors.

SUMMARY OF THE INVENTION

It is therefore an object of the present invention to provide a damper control and lighting assembly housing for use in a refrigerator which may be readily mounted to the refrigerator top wall, is easily accessible for repair and maintenance, provides effective and simplistic damper control, and illuminates all control dials through one source which is also used to illuminate the refrigerator compartment.

In accordance with one aspect of the present invention there is provided a refrigerator having an freezer food compartment, a fresh food compartment, and a mullion partition separating the freezer food compartment from the fresh food compartment. The mullion partition has a lower wall defining an upper wall of the fresh food compartment. An air flow passageway is disposed between the freezer and fresh food compartments with an air flow outlet in a rear wall of the fresh food compartment. An air damper is mounted for sliding movement across the air flow passageway to control air flow into the fresh food compartment through the air flow outlet. A damper control and lighting assembly housing is mounted to the upper wall of the fresh food compartment. The housing comprises a bridge section extending across the width of the fresh food compartment and mounted against the upper wall of the fresh food compartment. The housing has first and second rotating dials located in the bridge section. The first dial controls the temperature of the refrigerator and the second dial operates the air damper to control air flow into the refrigerator fresh food compartment. The second dial has a circumference disk shaped surface, a post extending outwardly from the disk shaped surface, and a dial flange extending around a major circumference portion of the disk shaped surface. The dial flange has two edges spaced circumferentially apart from each other around the dial. The housing has a connecting arm having the air damper at a first end thereof. The connecting arm extends towards the second dial. The connecting arm has at its second end an opening for receiving the post of the second dial. Rotational movement of the second dial directly imparts substantially linear movement of the connecting arm to move the air damper to control air flow through the air outlet. The linear movement of the connecting arm and rotational movement of the second dial is limited by the two edges of the dial flange engaging opposing sides of the connecting arm depending on rotational directional movement of the second dial.

By limiting rotational movement of the dial, the dial flange effectively controls linear movement of the connecting arm and regulation of air through the air outlet. The housing permits for easy access to a user of the control dials at the front of the refrigerator while operating a damper at the rear of the refrigerator. The control mechanism is mounted below the refrigerator food compartment upper wall and in front of the rear wall making it easy to replace and repair.

In the preferred embodiment, the rotation of the second dial is limited by the two edges of the dial flange to an angle of less than 120 degrees.

In accordance another aspect of the present invention there is provided a refrigerator having an freezer food compartment, a fresh food compartment, and a mullion partition separating the freezer food compartment from the fresh food compartment, the mullion partition has a lower wall defining the upper wall of the fresh food compartment. The improvement is a damper control and lighting assembly housing mounted to the upper wall of the fresh food compartment. The housing comprises a bridge section extending across the width of the fresh food compartment having a forward flange laying flush against the upper wall of the fresh food compartment. The forward flange includes spaced apart openings through which mounting fasteners pass to mount the bridge section to the upper wall of the fresh food compartment. A front facing panel display wall extends down from the bridge section into the fresh food compartment rearwardly and perpendicular to the forward flange and is easily accessible to a user. The front facing panel display wall has cut-out sections. The first and second dials each having a portion passing through a corresponding cut-out section in the front facing panel display wall for viewing and adjustment by a user. The first and second dials are located in the bridge section and are adapted to rotate about a corresponding vertical axis. The first dial controls the temperature of the refrigerator and the second dial operates a damper to control air flow into the fresh food compartment. The housing has a bulb shaped receiving surface spaced rearwardly of and below the front facing panel display wall. The bulb shaped receiving surface is adapted to receive an incandescent lamp utilized for illuminating fresh food compartment. The incandescent lamp has a line of sight passing over the bulb shaped receiving surface with at least a portion of the first dial to illuminate the first dial.

In the preferred construction, the incandescent lamp is housed within the bridge section and the bridge section has a cut out side wall portion adjacent the incandescent lamp permitting direct line of sight illumination with at least a portion of the second dial.

By permitting direct line of sight illumination of the dials by the lamp that illuminates the fresh food compartment, fiber optic light transmission is not required or the use of direct source lamps behind the dials is not required.

BRIEF DESCRIPTION OF THE DRAWINGS

For a better understanding of the nature and objects of the present invention reference may be had to the following detailed description when taken in conjunction with the accompanying diagrammatic drawings wherein.

DETAILED DESCRIPTION OF PREFERRED EMBODIMENTS

Figure 1:
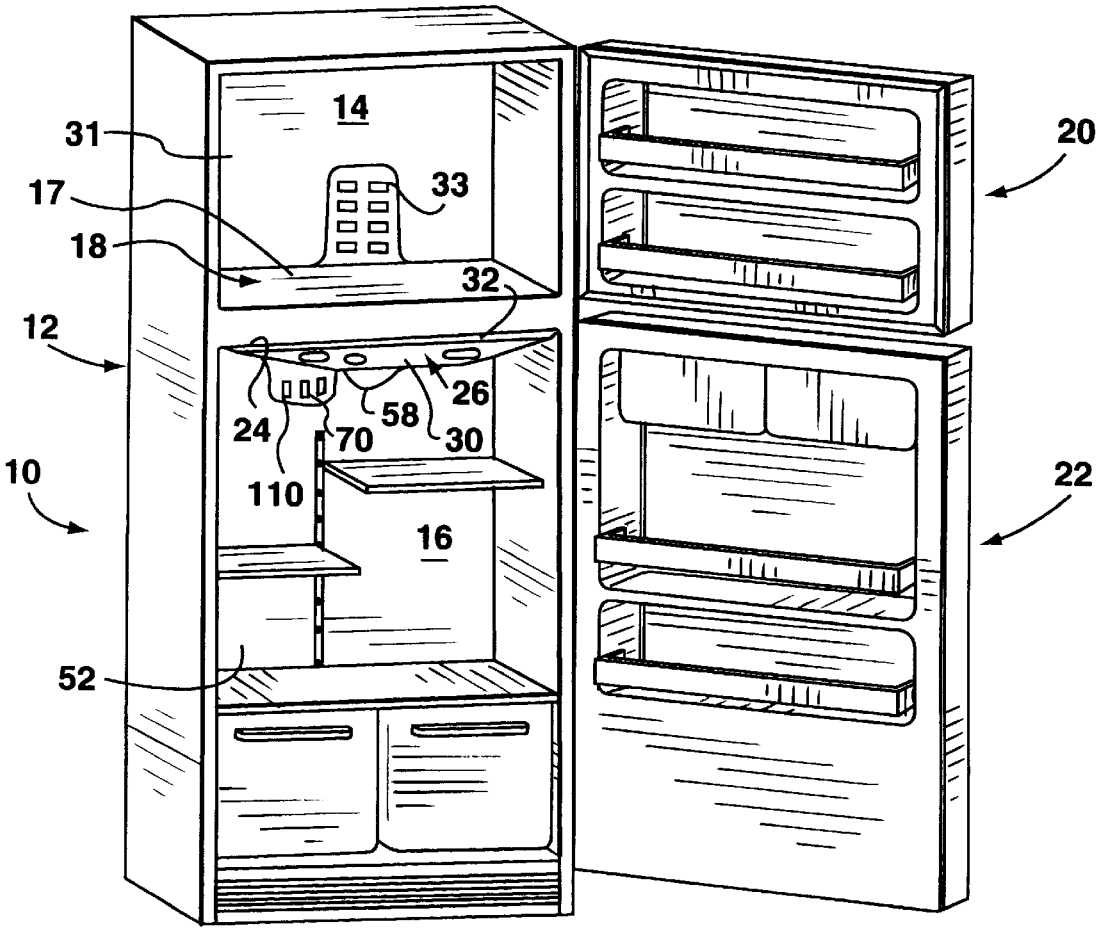
FIG. 1 is a perspective view of a refrigerator including the damper control and lighting assembly housing of the present invention.

Referring to FIG. 1 there is shown a top mount refrigerator 10 having an outer shell 12 and an interior upper freezer compartment 14 and a lower fresh food compartment 16 separated by a mullion partition 18. The freezer compartment 14 has an access door 20 and the fresh food compartment 16 has an access door 22. As shown, the refrigerator normally has numerous pans and shelves for storing food items.

Located at the on the lower wall 24 of the mullion partition 18, or the upper wall 24 of the fresh food compartment 16, is a damper control and lighting assembly housing 26. The mullion partition 18 has a generally upper surface or wall 17 which in effect is the bottom or floor of the freezer compartment 14. Between the lower wall 24 and upper wall of the mullion partition is thermal insulation so that the difference in temperatures between the freezer compartment and fresh food compartment can be maintained in their proper temperature ranges.

The refrigerant system of the refrigerator includes an evaporator (not shown) which is normally located either behind the freezer compartment rear wall 31, or within the mullion partition 18, and an evaporator fan (not shown) will force the air to circulate through duct 33 into the freezer compartment with a portion being diverted downwardly into the fresh food compartment 16 by means of a duct or air passage way (not shown). The cold air passes entering the fresh food compartment 16 passes through the damper control assembly housing 26.

The damper control and lighting assembly housing 26 is mounted at the top wall 24 of the fresh food compartment 16. The housing 26 has a bridge section 30 extending across the width of the fresh food compartment 16. The bridge section 30 has a forward flange 32 that lies flush against the upper wall 24 of the fresh food compartment 16. The forward flange 32 includes spaced apart openings 34 through which mounting fasteners in the form of screws pass to mount the bridge section 30 to the upper wall 24 of the fresh food compartment 16. The housing includes a front facing panel display 38 which extends downwardly from the forward flange 32 into the fresh food compartment 16. The front facing panel display wall 38 extends rearwardly of and perpendicular to the forward flange 32 and includes first and second control dials 42, 44 mounted for rotation about respective vertical axes 46. The first and second dials 42 and 44 each have a portion that passes through a corresponding cut out section 40 and the front facing panel display wall 38 for viewing and adjustment by the user. The first dial 42 controls the temperature of the refrigerator by controlling a thermostat 48 connected along the wire 54 passing through the housing to the rear wall of 52 of the fresh food compartment to a sensor 50 which senses the temperature of the air entering the fresh food compartment. The second dial 44 operates a damper 56 also located at the rear wall 52 of the refrigerator to be described in more detail hereinafter. Also mounted to the front control panel is a push button relay switch 55 which controls the actuation of the lamp 60 located in the refrigerator when the door is open and closed.

Figure 2:
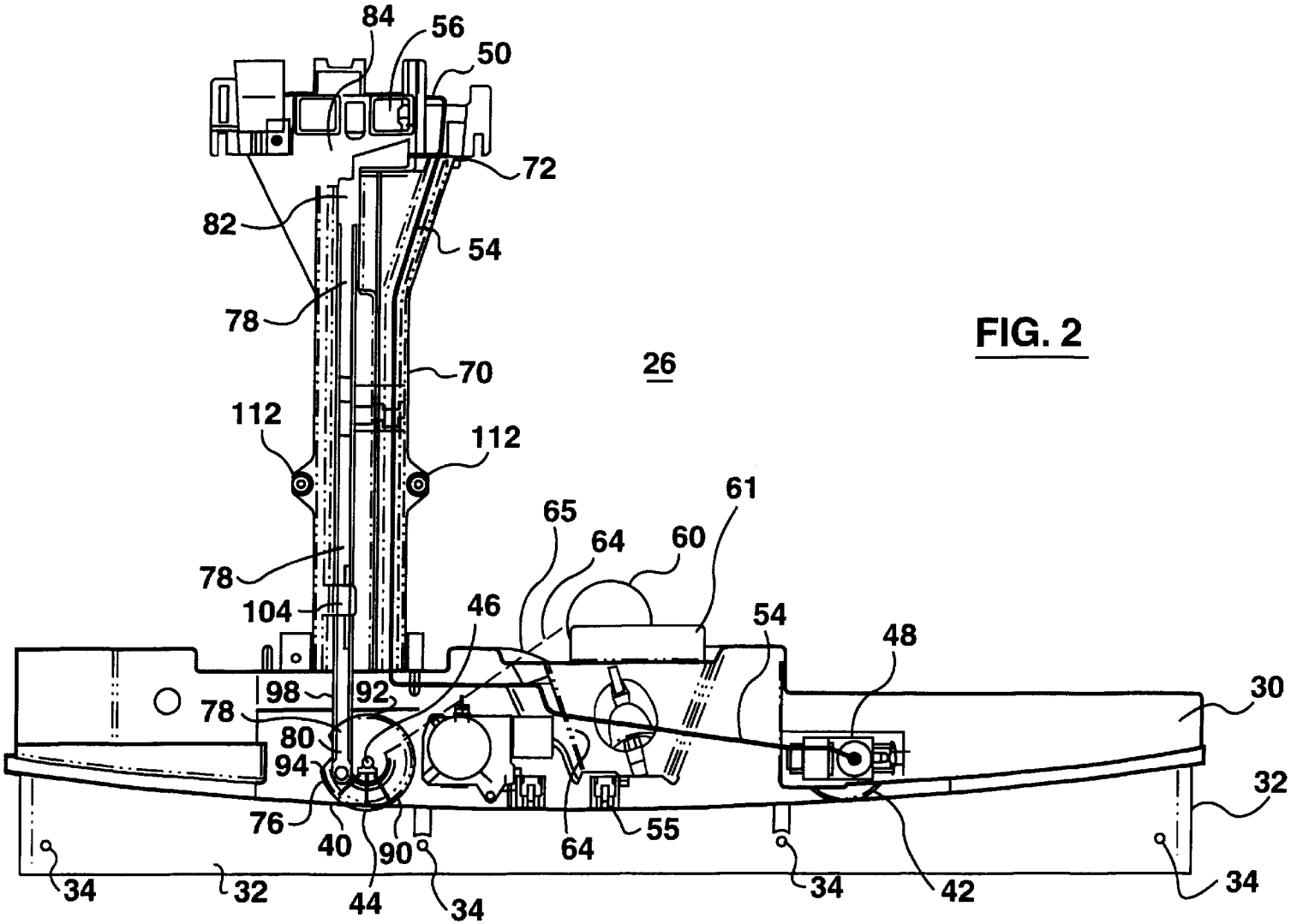
FIG. 2 is a plan view of the damper control and lighting assembly housing of the present invention.
Figure 3:
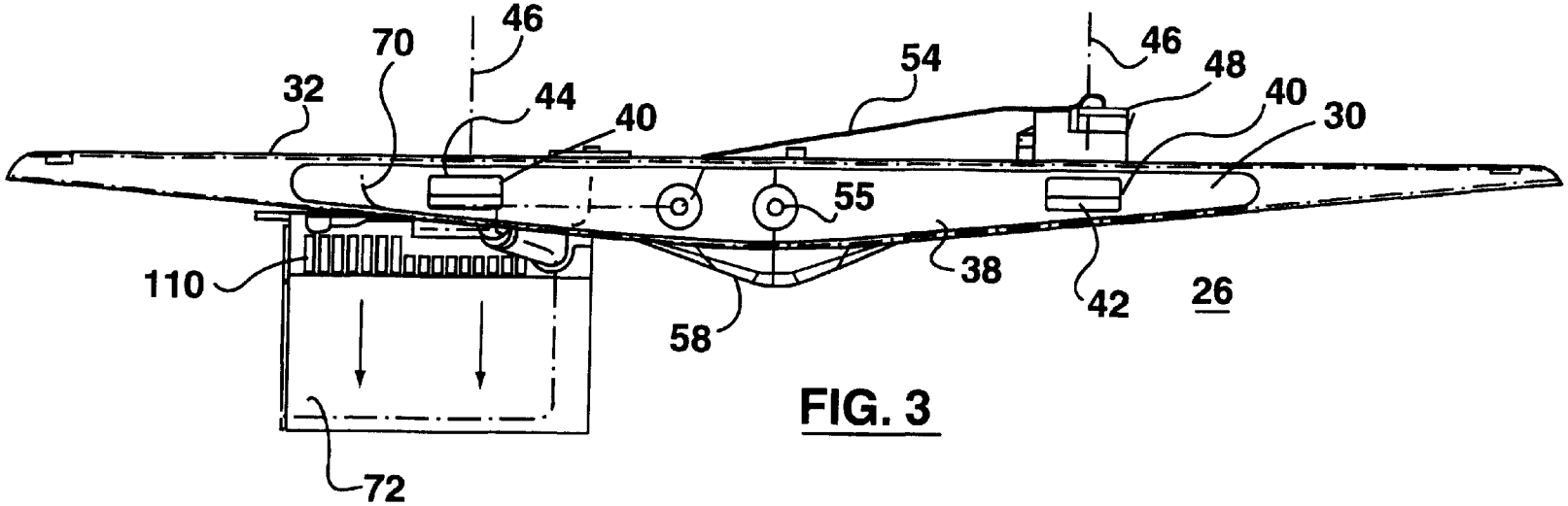
FIG. 3 is a front view of the damper control and lighting assembly housing of the present invention; and, FIG. 4 is a side view of the damper control and lighting assembly housing of the present invention.
Figure 4:
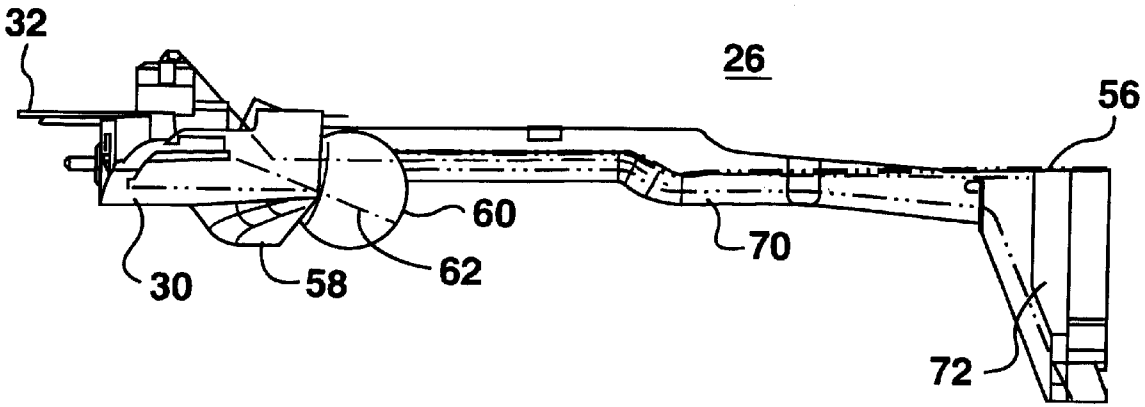

The housing 26 further includes a bulb shaped receiving surface 58 spaced rearwardly of and below the front facing display wall 38. The bulb shaped receiving surface 58 is adapted to receive an incandescent lamp 60 which is utilized to light up the fresh food compartment 16. In incandescent lamp 60 has a line of sight 62 (see FIG. 4) between an outside circumferal edge of the incandescent lamp 60 that passes over the bulb shaped receiving surface 58 and illuminates at least a portion of the first dial 42 to illuminate the first dial 42 to a user. The incandescent lamp 60 is housed within the bridge section 30 which includes a reflector 61. A side wall 64 has a portion thereof 65 removed adjacent to the incandescent lamp 60 that permits a direct line of sight 64 (see FIG. 2) between the incandescent lamp bulb 60 and at least a portion of the second dial 44.

The direct line of sight permits light emitted from lamp 60 to pass from the lamp 60 back to the dials 42, 44 to illuminate the dials without the use of any additional light source while at the same time allowing for a majority of the light emitted from lamp 60 to be concentrated and directed into the fresh food compartment 16.

The housing 26 further includes a generally U-shaped channel section 70 that extends along the top wall 24 of the fresh food compartment 16 rearwardly from the bridging section 30. The housing 26 includes a rear wall section 72 covering the opening in the rear wall 52 of the fresh food compartment 16. The second dial 44 is positioned forwardly of the general U-shaped channel 70.

The second dial 44 has a post 76 that is mounted to a connecting arm 78 that extends along the U-shaped channel 70 between the U-shaped channel 70 and the upper wall 24 of the fresh food compartment 16. The connecting arm 78 has a first end 80 connected to the post 76 with an opening which passes simply over the post 76 of the second dial 44. The connecting arm 78 has a second end 82 that has attached to damper 84. The second dial 44 partially rotates at an angle of less than 120 degrees to generally move the connecting arm 78 longitudinally in the U-shaped section 70 to move the damper 84 to control air flow into the fresh food compartment 16.

To limit the motion of or the rotation of the dial to approximately 100 degrees, the second dial 44 includes a raised flange or dial flange 90 that extends around a portion of the circumference of the dial 44. The range flange 90 has two ends 92 and 94 that are each adapted to contact an opposing respective side 96, 98 of the connecting arm 78 and limit the circular movement of the second dial 44. This also limits the longitudinal and movement of the connecting arm 78. The housing further includes a rear grill 110 adapted to cover the air outlet opening in the real wall 52 of the fresh food compartment 16. The U-shaped channel section 70 further includes openings 112 mounted flush with the upper wall 24 of the fresh food compartment 16 through which fasteners pass to mount the U-shaped channel section 70 to the upper wall 24.

Effectively, a simple construction for controlling dampening operation or regulating air flow into the refrigerator compartment is accomplished by the use of rotating dial 44 translating the rotational movement into direct linear movement of the connecting arm 78 where the limitation or restriction of the connecting arm 78 is limited by the circumferential flange 70 of the dial 44 which does not extend completely around the periphery or circumference of the dial 44.

The U-shaped section 70 includes a top tab member 109 that extends over the connecting arm 78 to prevent the connecting arm 78 from bowing up and disconnecting from the post 76 as the connecting arm 78 moves linearly to open and close the damper.

As is apparent from the forgoing disclosure, various other embodiments and alterations and modifications which may differ from the embodiments disclosed may be readily apparent to one skilled in the art. In particular the preferred embodiment has been limited the description of a top mount refrigerator and the invention may have application to bottom mount refrigerators. It should be understood that the scope of the patent shall be defined by the claims and those embodiments which come within the scope of the claims that follow.

What is claimed is:

1. A refrigerator having an freezer food compartment, a fresh food compartment, and a mullion partition separating the freezer food compartment from the fresh food compartment, the mullion partition having a lower wall defining the upper wall of the fresh food compartment, an air flow passageway disposed between the freezer and fresh food compartments with an air flow outlet in a rear wall of the fresh food compartment;

an air damper mounted for sliding movement across the air flow passageway to control air flow into the fresh food compartment through the air flow outlet; and, a damper control and lighting assembly housing mounted to the upper wall of the fresh food compartment comprising:

bridge section extending across the width of the fresh food compartment and mounted against the upper wall of the fresh food compartment;

first and second rotating dials located in the bridge section, the first dial controlling the temperature of the refrigerator and the second dial operating the air damper to control air flow into the fresh food compartment;

the second dial having a circumference disk shaped surface, a post extending outwardly from the disk shaped surface, and a dial flange extending circumferentially around a major portion of the disk shaped surface, the dial flange having two edges spaced circumferentially apart from each other around the dial;

a connecting arm having the air damper at a first end thereof and extending towards the second dial, the connecting arm having at its second end an opening for receiving the post of the second dial; and, rotational movement of the second dial directly imparting substantially linear movement of the connecting arm to move the air damper to control air flow through the air flow outlet, linear movement of the connecting arm and rotational movement of the second dial being limited by the two edges of the dial flange engaging opposing sides of the connecting arm depending upon rotational directional movement of the second dial.

2. The refrigerator of claim 1 wherein the damper control and lighting assembly housing further includes a forward flange and a front facing panel display wall extending down from the bridge section into the fresh food compartment rearwardly and perpendicular to the forward flange, the front facing panel display wall having cut-out sections through which a portion of the rotating dials pass for viewing and adjustment by a user.

3. The refrigerator of claim 2 wherein the damper control and lighting assembly housing further includes a bulb shaped receiving surface spaced rearwardly of and below the front facing panel display wall; an incandescent lamp mounted within the bulb shaped receiving surface for illuminating fresh food compartment, the incandescent lamp having a line of sight passing over the bulb shaped receiving surface with at least a portion of the first dial to illuminate the first dial.

4. The refrigerator of claim 3 wherein the incandescent lamp is housed within the bridge section and the bridge section has a cut-out side wall portion adjacent the incandescent lamp permitting direct line of sight illumination with at least a portion of the second dial.

5. The refrigerator of claim 1 wherein the housing further includes a generally U-shaped channel section extending along the upper wall of the fresh food compartment rearwardly from the bridge section, and the housing including a rear wall section adapted to cover a opening a rear wall of the fresh food compartment, the second dial being positioned forward of the generally U-shaped channel, and the U-shaped channel section covering the connecting arm member.

6. The refrigerator of claim 1 wherein rotation of the second dial is limited by the two edges of the dial flange to an angle of less than 120 degrees.

7. The refrigerator of claim 1 wherein the wherein the housing further includes a rear grill adapted to cover the opening in the rear wall of the fresh food compartment.

8. The refrigerator of claim 5 wherein the u-shaped channel section includes a stop that extends over the connecting arm to prevent the connecting arm from bowing.

9. A refrigerator having an freezer food compartment, a fresh food compartment, and a mullion partition separating the freezer food compartment from the fresh food compartment, the mullion partition having a lower wall defining an upper wall of the fresh food compartment, the improvement comprising a damper control and lighting assembly housing mounted to the upper wall of the fresh food compartment and comprising:

a bridge section extending across the width of the fresh food compartment having a forward flange laying flush against the upper wall of the fresh food compartment, the forward flange including spaced apart openings through which mounting fasteners pass to mount the bridge section to the upper wall of the fresh food compartment, a front facing panel display wall extending down from the bridge section into the fresh food compartment rearwardly and perpendicular to the forward flange, and the front facing panel display wall having cut-out sections;

first and second dials located in the bridge section and adapted to rotate about a corresponding vertical axis, the first dial controlling the temperature of the refrigerator and the second dial operating a damper to control air flow into the fresh food compartment; the first and second dials each having a portion passing through a corresponding cut-out section in the front facing panel display wall for viewing and adjustment by a user; and, a bulb shaped receiving surface spaced rearwardly of and below the front facing panel display wall, the bulb shaped receiving surface being adapted to receive an incandescent lamp utilized for illuminating fresh food compartment, the incandescent lamp having a line of sight passing over the bulb shaped receiving surface with at least a portion of at least one dial of the first and second dial to illuminate at least one dial.

10. The refrigerator of claim 9 wherein the incandescent lamp is housed within the bridge section and the bridge section has a cut out side wall portion adjacent the incandescent lamp permitting direct line of sight illumination with at least a portion of at least the other dial of the first and second dials.

11. The refrigerator of claim 9 wherein the housing further includes a generally U-shaped channel section extending along the upper wall of the fresh food compartment rearwardly from the bridging section, and the housing including a rear wall section adapted to cover a opening a rear wall of the fresh food compartment, the second dial being positioned forward of the generally U-shaped channel, the second dial having a post, and a connecting arm member extending between the U-shaped channel and the upper wall of the fresh food compartment, the connecting arm having a first end connected to the post of the second dial and a second end having a damper connected thereto, the second dial partially rotating an angle of less than 120 degrees to generally move the connecting arm longitudinally in the U-shaped section to move the damper to control air flow into the fresh food compartment.

12. The refrigerator of claim 11 wherein the second dial includes a raised flange extending around a portion of the circumference of the dial, the raised flange having two ends each adapted to contact opposing sides of the connecting arm and limit circular movement of the dial and longitudinal movement of the connecting arm.

13. The refrigerator of claim 11 wherein the wherein the housing further includes a rear grill adapted to cover the opening in the rear wall of the fresh food compartment.

14. The refrigerator of claim 11 wherein the U-shaped channel section further includes openings mounted flush with the upper wall of the fresh food compartment through which fasteners pass to mount the U-shaped channel section to the upper wall.

15. The refrigerator of claim 11 wherein the u-shaped channel section includes a stop that extends over the connecting arm to prevent the connecting arm from bowing.

* * * * *